United States Patent [19]

Tyssee

[11] 3,945,896

[45] Mar. 23, 1976

[54] ELECTROLYTIC CARBOXYLATION OF ACETONITRILE AND ALPHA-SUBSTITUTED ACETONITRILES

[75] Inventor: Donald A. Tyssee, St. Louis, Mo.

[73] Assignee: Monsanto Company, St. Louis, Mo.

[22] Filed: Aug. 28, 1974

[21] Appl. No.: 501,409

[52] U.S. Cl. ..... 204/59 R; 204/72; 204/73 R; 260/465 D; 260/465.4

[51] Int. Cl.[2] ..... C25B 3/04; C07C 121/407; C07C 51/00

[58] Field of Search ..... 204/73 R, 73 A, 59 R, 72; 260/465

[56] References Cited

UNITED STATES PATENTS

| | | | |
|---|---|---|---|
| 3,032,489 | 5/1962 | Loveland | 204/73 R |
| 3,193,481 | 7/1965 | Baizer et al. | 204/73 A |
| 3,344,045 | 9/1967 | Neikam | 204/59 R |
| 3,344,046 | 9/1967 | Neikam | 204/59 R |
| 3,413,202 | 11/1968 | Baizer et al. | 204/73 R |
| 3,556,961 | 1/1971 | Bizot et al. | 204/73 A |
| 3,616,322 | 10/1971 | Seko et al. | 204/73 A |
| 3,764,494 | 10/1973 | Allain et al. | 204/74 |

FOREIGN PATENTS OR APPLICATIONS

| | | | |
|---|---|---|---|
| 1,491,516 | 8/1967 | France | 204/73 A |

*Primary Examiner*—F. C. Edmundson

[57] ABSTRACT

Acetonitrile and alpha-substituted acetonitriles are electrolytically carboxylated to yield the corresponding alpha-cyano carboxyl compounds.

14 Claims, No Drawings

ELECTROLYTIC CARBOXYLATION OF ACETONITRILE AND ALPHA-SUBSTITUTED ACETONITRILES

SUMMARY OF THE INVENTION

According to the present invention, it has been discovered that acetonitrile and alpha-substituted acetonitriles can be electrolytically carboxylated in the presence of carbon dioxide to yield the corresponding alpha-cyano carboxylated product.

The alpha-cyano carboxylated products obtained in the present method can be recovered by a variety of procedures as the ester, salt, and free carboxylic acid.

DETAILED DESCRIPTION OF THE INVENTION

The reaction of the present invention can be illustrated:

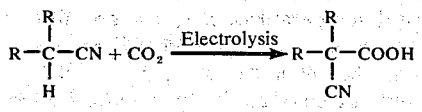

in which the R's are individually selected from hydrogen, alkyl containing 1 to 10 carbons, inclusive, aralkyl, aryl, oxy, thio, phosphino, and amino, including for example such groups as alkoxy, aryloxy, alkylthio, arylthio, alkylamino, arylamino, alkylsphosphino, arylphosphino, and various hydrocarbyloxy, hydrocarbylthio groups.

Representative compounds suitable for use in the present invention include, for example, acetonitrile, methoxyacetonitrile, ethoxyacetonitrile, propionitrile, alpha-methoxy-propionitrile, isobutyronitrile, gamma-methoxy-n-butyronitrile, phenylacetonitrile, alpha-methoxy-beta-phenylpropionitrile, gamma-methoxyvaleronitrile, methylthioacetonitrile, dimethyl-phosphinoacetonitrile, and dimethylaminoacetonitrile.

In carrying out the method of the present invention, an electric current is passed through the acetonitrile compound in contact with a cathode and in the presence of carbon dioxide. The acetonitrile compound or medium in which it is employed must have sufficient conductivity to conduct electric current. It is preferable from an economic viewpoint not to have too high a resistance. The required conductivity is generally achieved by employing common supporting electrolytes, such as electrolyte salts of sufficiently negative discharge potentials.

The present reaction may be effected in the presence of an additional solvent for the acetonitrile compound and the electrolyte; however, liquid acetonitrile compounds having sufficiently high dielectric constants may also serve as solvents when used in sufficient quantities. But whatever solvent is employed, whether the acetonitrile compound or a separate solvent, it will generally be desirable for the solvent to have a fairly high dielectric constant in order to lower electrical resistance. Separate solvents desirable for use herein include, for example, dimethylformamide, hexamethylphosphonamide, dimethyl sulfoxide, etc. In general, it is desirable to employ a solvent with a dielectric constant of at least 25, and preferable of at least 50.

The electrolytic carboxylation of the present method is conveniently carried out in a substantially anhydrous medium, although strict adherence to anhydrous conditons is not necessary for successful completion of the reaction.

In the present method it is generally desirable to have the electrolysis medium as a fairly homogeneous dispersion. A true solution is not required as, for example, many quaternary ammonium salt solutions may, in some respects, be dispersions rather than true solutions. Thus the present invention may use emulsions as well as true solutions. Moreover, in emulsions or media having more than one phase, electrolysis can occur in a solution of the components in one of the phases.

As indicated hereinabove, the required conductivity in the present method is generally achieved by employing common supporting electrolytes, such as electrolyte salts of sufficiently negative discharge potentials. With some acetonitrile compounds (and separate solvent when employed), an additional electrolyte may not actually be necessary, but in practice a supporting electrolyte is utilized. A supporting electrolyte, as understood by those in the art, is an electrolyte capable of carrying current but not discharging under the electrolysis conditions. In the present invention, this primarily concerns discharge at the cathode, as the desired reaction occurs at the cathode. Thus the electrolyte employed will generaly have cations of more negative cathodic discharge potential than the discharge potentials of both the acetonitrile compound and carbon dioxide. But whatever the actual mechanistic pathway, whether by way of reduction of the acetonitrile compound or by way of reduction of carbon dioxide, it will be recognized that discharge potentials will vary with cathodic materials and their surface conditions, and various materials in the electrolysis medium. In order for the reaction to proceed, however, it is only necessary to have an effective reduction of the appropriate compound under the conditions of the electrolysis, and some salts may be effective supporting electrolytes under such conditions even though nominally of less negative discharge potential than the compound being reduced at the cathode.

The term salt is employed in its generally recognized sense to indicate a compound composed of a cation and an anion, such as produced by a reaction of an acid with a base. The salts can be organic, or inorganic, or mixtures of such, and composed of simple cations and anions or very large complex cations and anions.

Certain salts of alkali and alkaline earth metals can be employed to some extent; however, amine and quaternary ammonium salts are generally more suitable and preferred for use herein, as such salts generally have very negative discharge potential—that is, more than −2.2 cathodic volts versus the saturated calomel electrode. Among the quaternary ammonium salts useful, are the tetralkylammonium, for example, tetramethylammonium, tetraethylammonium, methyltriethylammonium etc., heterocyclic and aralkylammonium salts, for example, benzyltrimethylammonium, etc.

The term "quaternary ammonium" as employed herein has its usual recognized meaning of a cation having four organic groups substituted on the nitrogen.

Various anions can be used with the foregoing and other cations, for example, organic and inorganic anions, such as tetrafluoroborates, phosphates, halides, sulfates, sulfonates, alkanesulfonates, etc. Aromatic sulfonates and similar anions, including those referred to as McKee salts, can be used, as can other hydrotropic salts, although the hydrotropic property may be of no particular significance when employed with very low water content.

The concentration of salts, when used, can vary widely, for example, from 0.5 percent to 50 percent or more by weight of the electrolysis medium, but suitable concentrations will often be in the range of 1.0 percent to 15 percent by weight, or on a molar basis, often in the range of 0.1 to 1.0 molar. If it is desired to have all the components in solution, the amount of salt utilized will be no greater than will dissolve in the electrolysis medium.

Various current densities can be employed in the present method. It will be desirable to employ high current densities in order to achieve high use of electrolysis cell capacity, and therefore for production purposes it will generally be desirable to use as high a density as feasible, taking into consideration sources and cost of electrical current, resistance of the electrolysis medium, heat dissipation, effect upon yields, etc. Over broad ranges of current density, the density will not greatly affect the yield. While very low densities are operable, suitable ranges for efficient operation will generally be in ranges from a few amperes per square decimeter of cathode surface, up to 10 or 100 or more amperes per square decimeter.

The present electrolysis can be conducted in the various types of electrolysis cells known in the art. In general, such cells comprise a container made of material capable of resisting action of electrolytes, for example, glass or plastic, and a cathode and anode, which are electrically connected to sources of electric current. The anode can be of any electrode material so long as it is relatively inert under the reaction conditions. Ordinarily, the anode will have little or no influence on the course of the electrolysis, and can be selected so as to minimize expense and any corrosion, or erosion problems.

Any suitable material can be employed as the cathode, various metals, alloys, graphite, etc. being known to the art. However, the cathode material can have some effect upon the ease and efficiency of the reaction. For example, mercury, cadmium, lead, and carbon cathodes are suitable.

In the present method a divided cell will often be employed, that is, some separator will prevent the free flow of reactants between cathode and anode. Generally, the separator is some mechanical barrier which is relatively inert to the electrolyte material, for example, a fritted glass filter, glass cloth, asbestos, porous poly(vinyl chloride), etc. An ion exchange membrane can also be employed. The desired reactions will occur in an undivided cell, and this could have advantages for industrial production in that electrical resistance across a cell-divider is eliminated.

When a divided cell is used, it will be possible to employ the same electrolysis medium on both the cathode and anode sides, or to employ different media. In some circumstances, it may be advisable to employ a different anolyte for economy of materials, lower electrical resistance, etc.

The electrolysis cells employed in the procedural Examples herein is primarily for laboratory demonstration purposes. Production cells are usually designed with a view to the economics of the method, and characteristically have large electrode surfaces, and short distances between electrodes. The present method is suited to either batch or continuous operations. Continuous operations can involve recirculation of a flowing electrolyte stream, or streams between electrodes, with continuous or intermittent sampling of the stream for product removal. Similarly, additional reactants can be added continuously or intermittently, and salt or other electrolyte component can be augmented, replenished, or removed as appropriate. Additional description of a suitable cell for continuous operation is set forth in Baizer et al., U.S. Pat. No. 3,193,480. See also H. Lund et al., in *Organic Electrochemistry* (M. M. Baizer, et al), Marcel Dekker, New York, 1973, pp. 65 ff. for a general description of various laboratory scale cells, and D. Danly, ibid, pp. 907 ff. for some consideration of industrial cell designs.

The electrolysis can be conducted at ambient temperatures, or at higher or lower temperatures. If volatile materials are utilized, it may be desirable to avoid elevated temperatures so that the volatile reactant will not escape, and various cooling means can be used for this purpose in preference to pressure vessels. Cooling to ambient temperatures may be appropriate, but if desired, temperatures down to 0°C or lower can be employed. The amount of cooling capacity needed for the desired degree of control will depend upon the cell resistance and the electrical current drawn. If desired, cooling can be effected by immersing the electrolysis cell in an ice or ice-salt bath. Pressure can be employed to permit electrolysis at higher temperatures with volatile reactants, but unnecessary employment of pressure is usually undesirable from an economic standpoint.

The method of the present invention involves a carboxylation reaction, and therefore requires a source of the carboxyl groups. Carbon dioxide admirably serves this purpose. The carbon dioxide can be supplied at atmospheric pressure or at a higher pressure, for example 50 or 100 atmospheres or more of carbon dioxide. Other sources can also be used, such as alkali metal carbonates, for example, sodium bicarbonate, or various other materials equivalent to or a source of carbon dioxide or carbonic acid. The present invention contemplates reactions occurring in the presence of carbon dioxide, regardless of its source.

The alpha-cyano carboxyl compounds produced in the present invention can be recovered in the form of the free acid, ester, or salt. Because nitriles are employed in the method of the present invention, it will ordinarily be desirable to avoid conditions known to result in hydrolysis of the nitrile group, such as excessively acidic or basic conditions with elevated temperatures.

The isolation procedures employed in the procedural Examples and discussed hereinbelow are primarily for illustrative purposes. Other procedures can be employed, and may be preferred, for commercial use.

Upon completion of the electrolysis the excess acetonitrile compound (and separate solvent when employed) are removed by vacuum aspiration at ambient temperatures. The remaining residue is taken up in water, and the mixture made basic, preferably to about pH 10 by the addition of solid alkali metal hydroxide, for example, sodium hydroxide. Extraction of the basic solution with an appropriate solvent, such as, for example, ethyl ether or methylene chloride to remove neutral material leaves an aqueous solution of the salt of the alpha-cyano carboxylic acid. Mild acidification of the extracted aqueous solution with mineral acid followed by extraction with an appropriate organic solvent, for example, ethyl ether, which is thereafter dried over an appropriate desiccant yields an organic solution of the free acid. Treatment of this solution with an amine, such as, for example, benzylamine, yields the substituted ammonium salt of the carboxylic acid.

Alternatively, the organic solvent extract from the acidified aqueous solution may be dried and evaporated to yield the free alpha-cyanocarboxylic acid.

The free acid may also be obtained from the substituted ammonium salt by treating an aqueous solution of the salt with mineral acid, extracting with an organic solvent, such as, for example, ethyl ether, drying the extracts, and evaporating the organic solvent.

A further alternative is to isolate the carboxylated product as the ester. The product, which exists as the carboxylic acid anion because of the presence of salts in the electrolysis, can be alkylated by treatment of the catholyte with an alkylating agent, such as, for example, methyl iodide or dimethyl sulfate. Evaporation of the resulting mixture to dryness and extraction of the residue with an appropriate organic solvent, such as ethyl ether, filtering to remove the undissolved material, and removal of the solvent provides the ester.

The following examples illustrate the present invention and the manner by which it can be practiced.

EXAMPLE 1

Electrolytic Carboxylation of Acetonitrile

Procedure A

A typical two-compartment H cell having a 250-milliliter cathode compartment was employed. The cathode and anode compartments were separated by a medium porosity glass frit. The cathode was a mercury pool (50 $cm^2$ surface area) and the anode was platinum. The cathode compartment contained an inlet and outlet for carbon dioxide but was otherwise gas tight. An electrolyte solution comprising 0.15 molar solution of tetraalkylammonium tosylate in acetonitrile was added to the cathode and anode compartments, and the cell was cooled to about 0°C in an ice bath. Dry carbon dioxide was continuously bubbled into the solution at atmospheric pressure during the electrolysis, which was conducted with an observed cathode potential of -2.0 volts (versus the saturated calomel electrode) while maintaining a constant current of 0.7 ampere. The electrolysis was continued until 0.07 faraday of current was expended. Upon completion of the electrolysis, the remaining acetonitrile was removed by vacuum aspiration to leave a viscous residue to which was added about 30 milliliters of water. The resulting mixture was made basic to about pH 10 by the addition of solid sodium hydroxide and extracted with five 50-milliliter portions of ethyl ether, which were discarded. The remaining aqueous solution was acidified to pH 1 with concentrated hydrochloric acid and extracted with ten 50-milliliter portions of ethyl ether. The combined ethereal extracts were dried over anhydrous magnesium sulfate, filtered, and treated with excess benzylamine to yield a white precipitate which was collected by vacuum filtration, washed with anhydrous ethyl ether, and dried to yield 0.926 grams of benzylammonium cyanoacetate. This yield, the equivalent of 0.41 grams of cyanoacetic acid, corresponds to 0.216 grams of acid per ampere-hour or 5.8 grams per faraday.

Procedure B

The apparatus described in Procedure A above was employed. To the 150-milliliter catholyte medium comprising a solution of 0.15 molar tetraethylammonium tetrafluoroborate in dimethylformamide was added 15 milliliters of acetonitrile. Thereafter the cell was placed in an ice bath and cooled to about 0°C. Dry carbon dioxide was bubbled continuously into the catholyte at atmospheric pressure during the electrolysis. The electrolysis, conducted at a temperature between 0°C and 10°C and with an observed cathode potential of −2.0 volts while maintaining a constant current of 0.7 ampere, was continued until 0.1 faraday of current was expended. Upon completion of the electrolysis, the product was isolated as the benzylammonium salt as described for Procedure A above. The 0.87-gram yield of benzylammonium cyanoacetate, the equivalent of 0.39 grams of cyanoacetic acid, corresponds to 0.146 grams of acid per ampere-hour or 3.9 grams per faraday.

EXAMPLE 2

Electrolytic Carboxylation of Methoxyacetonitrile

Following Procedure A of Example 1 above, an electrolyte solution comprising 13.0 grams (0.043 mole) of tetraethylammonium tosylate dissolved in 200.0 grams (2.82 moles) of methoxyacetonitrile was electrolytically carboxylated at about 23°C with a constant current of 0.3 ampere for 5.5 hours (1.65 ampere-hours). The desired methoxycyanoacetic acid was isolated as the benxylammonium salt (1.0 gram). The free acid equivalent of 0.52 gram corresponds to 0.313 gram of acid per ampere-hour or 8.4 grams per faraday.

The alpha-carboxylated compounds produced in the present method are suitable for numerous purposes. Cyanoacetic acid and its derivatives, including the corresponding esters are valuable organic intermediates, being utilized as starting material for numerous syntheses in the pharmaceutical field. For example, cyanoacetic acid and its ethyl ester are useful in the manufacture of barbiturates; the ethyl ester is useful in the preparation of numerous 4-substituted 1-cyanoacetyl-3-thiosemicarbazides which are useful as anti-parasitic and antifungal agents; and butyl cyanoacetate is useful in the preparation of caffeine. Many other derivatives are useful in the manufacture of vitamin B, (thiamine), vitamin $B_6$ (pyridoxine), various amino acids (for example, ornithine, tryptophane, and glutamic acid), and various hypnotics such as the 3,3-dialkyl derivatives of 6-methyl-2,4(1H,3H)-pyridinedione. In addition, derivatives such as cyanoacetylurea and cyanoacetyl guanidine are couplers suitable for use in photographic developers and emulsions.

While the invention has been described with respect to various specific examples and embodiments thereof, it is to be understood that the invention is not limited thereto and that it can be variously practiced within the scope of the following claims.

1. The method of electrolytic carboxylation of acetonitrile and alpha-substituted acetonitriles having at least one hydrogen attached to the carbon located alpha to the cyano group, where the alpha substituent is hydrogen or an organic group selected from alkyl containing 1 to 10 carbons, inclusive, aralkyl, aryl, oxy, thio, phosphino, and amino, which comprises electrolytic reduction at the cathode by electrolysis in a liquid medium consisting essentially of such acetonitrile compound, supporting electrolyte, and added carbon dioxide, and recovering an alpha-cyano carboxylated product of such acetonitrile compound.

2. The method of claim 1 wherein the acetonitrile compound is an alkanenitrile.

3. The method of claim 2 wherein the alkanenitrile is acetonitrile.

4. The method of claim 1 wherein the acetonitrile compound is an alpha-alkoxyacetonitrile.

5. The method of claim 4 wherein the alpha-alkoxyacetonitrile is methoxyacetonitrile.

6. The method of claim 1 wherein the liquid electrolysis medium contains an additional solvent.

7. The method of claim 6 wherein the additional solvent is dimethylformamide.

8. The method of claim 1 wherein a mercury pool cathode and a platinum anode are used.

9. The method of claim 1 wherein a quaternary ammonium salt electrolyte is used.

10. The method of claim 1 wherein the added carbon dioxide is supplied to the electrolysis medium as a continuous gaseous stream.

11. The method of claim 1 wherein the liquid electrolysis medium is substantially anhydrous.

12. The method of claim 1 wherein the cathode potential is sufficient to effect reductive carboxylation of acetonitrile and alpha-substituted acetonitriles.

13. The method of claim 12 wherein the cathode potential is about −2.0 volts.

14. The method of claim 2 wherein the alkanenitrile is propanenitrile.

* * * * *